United States Patent [19]

Rebiez et al.

[11] Patent Number: 4,888,597

[45] Date of Patent: Dec. 19, 1989

[54] MILLIMETER AND SUBMILLIMETER WAVE ANTENNA STRUCTURE

[75] Inventors: Gabriel M. Rebiez; David B. Rutledge, both of Pasadena, Calif.

[73] Assignee: California Institute of Technology, Pasadena, Calif.

[21] Appl. No.: 132,015

[22] Filed: Dec. 14, 1987

[51] Int. Cl.[4] ..... H01Q 1/38; H01Q 13/02

[52] U.S. Cl. ..... 343/778; 343/786; 343/789; 29/600

[58] Field of Search ..... 343/786, 789, 778, 795, 343/810, 700 MS File, 776, 779; 29/600

[56] References Cited

U.S. PATENT DOCUMENTS 4,527,165 7/1985 deRonde ..... 343/786

4,614,947 9/1986 Rammos ..... 343/786

4,626,865 12/1986 Rammos ..... 343/786

4,644,362 2/1987 Rammos ..... 343/786

*Primary Examiner*—Rolf Hille

*Assistant Examiner*—Michael C. Wimer

*Attorney, Agent, or Firm*—William J. Benman, Jr.

[57] ABSTRACT

An integrated circuit antenna structure for transmitting or receiving millimeter and/or submillimeter wave radiation having an antenna relatively unimpaired by the antenna mounting arrangment is disclosed herein. The antenna structure of the present invention includes a horn disposed on a substrate for focusing electromagnetic energy with respect to an antenna. The antenna is suspended relative to the horn to receive or transmit the electromagnetic energy focused thereby.

4 Claims, 4 Drawing Sheets

MILLIMETER AND SUBMILLIMETER WAVE ANTENNA STRUCTURE

ORIGIN OF THE INVENTION

The invention described herein was made in the performance of work under a NASA contract, and is subject to the provisions of Public Law 96-517 (35 U.S.C. 202) in which the Contractor has elected to retain title.

BACKGROUND OF THE INVENTION

1. Field of the Invention

This invention relates to antennas for transmitting or receiving electromagnetic energy. More specifically, this invention relates to millimeter and submillimeter wave antennas.

While the present invention is described herein with reference to a particular embodiment for a particular application, it is understood that the invention is not limited thereto. Those having ordinary skill in the art and access to the teachings provided herein will recognize additional embodiments within the scope thereof.

2. Description of the Related Art

Conventional imaging systems which utilize infrared or visible light typically provide images of superior resolution under favorable atmospheric conditions. As is well known, however, environments laden with smoke, smog or fog may impede propagation of infrared or visible light thereby obscuring a scene to be imaged. Imaging systems designed to be operative under such adverse environmental conditions have tended to rely on lower frequency electromagnetic radiation. For example microwave imaging systems more effectively penetrate fog and smoke than do those using infrared or visible light. However, systems utilizing longer wavelength microwave radiation typically generate images having less resolution than images produced by higher frequency systems.

Millimeter and submillimeter wave imaging systems offer improved resolution relative to microwave systems while still exhibiting good fog and smoke penetration capability. Conventional millimeter wave imaging systems have generally been comprised of either waveguide components or of detection components mounted on a dielectric substrate. Waveguide receiving antennas included in waveguide imaging systems are capable of generating well defined antenna patterns which may enhance image clarity. However, the small dimensions of millimeter and submillimeter waveguide imaging systems may significantly increase the cost of such systems. Milling tolerances on the order of microns and typically small detection elements are two examples of attributes of many millimeter and submillimeter waveguide detection systems which may contribute to their characteristically high cost. Further, millimeter and submillimeter waveguide antenna arrays have proven to be prohibitively expensive for numerous applications because of the large cost of each antenna element.

In single antenna imaging systems the antenna element scans regions of a scene to provide a composite image. While this method may render accurate images when used in applications such as radio astronomy where imaging speed is not of primary concern, this scanning process inherently slows image formation which makes single element systems inappropriate for certain applications. Alternatively, antenna arrays generally increase imaging speed as each antenna element is responsible for detecting a specified region of a scene to be imaged. Given the expense of fabricating millimeter and submillimeter waveguide antenna arrays, attempts have been made at developing arrays of antenna elements mounted on dielectric substrates. The substrates provide mechanical support for antenna elements typically having dimensions on the order of half a millimeter and often lacking structural rigidity. Additionally, well developed lithographic techniques can be borrowed from VLSI circuit technology to facilitate fabrication of antenna elements and their associated detection and signal processing components.

While substrate mounted imaging antenna arrays may be manufactured at a fraction of the cost of comparable millimeter waveguide antenna imaging arrays, substrate mounting presents numerous disadvantages. Electromagnetic patterns generated by antennas mounted on substrates tend to be inferior to those produced by antennas radiating in free space. Further, substrate mounted arrays generally have more losses and less power handling capability than comparable waveguide systems. In planar substrate mounted antenna arrays antenna elements and interconnections are fabricated on a common surface. This planar implementation generally involves at least two design tradeoffs. First, space devoted to interconnections cannot typically be utilized by antenna elements hence limiting the efficiency of collection of incident electromagnetic energy. Second, planar systems affording increased collection efficieny through a more dense concentration of antenna elements may experience performance degradation due to electromagnetic coupling between antenna elements.

Multi-layer substrate antenna arrays have attempted to improve collection efficiency by providing a separate substrate for interconnections. However, this multilayer approach does not address the problem of parasitic coupling between antenna elements. Moreover, the orientation of the component substrates in the multilayer implementation often requires holes to be fabricated through the substrates providing for interconnection. This process may be difficult and expensive as a result of the inherently small dimensions of millimeter and submillimeter imaging antenna arrays. Further, multi-layer structures generally cannot exploit existing low cost integrated circuit manufacturing processes available for planar, monolithic implementations.

Hence, a need in the art exists for an inexpensive two-dimensional millimeter and submillimeter wave substrate antenna array providing efficient collection of incident electromagnetic energy and having antenna elements relatively unimpaired by a mounting arrangement.

SUMMARY OF THE INVENTION

The need in the art for a two dimensional antenna structure for transmitting or receiving millimeter and/or submillimeter wave radiation having an antenna relatively unimpaired by the antenna mounting arrangement is addressed by the integrated circuit antenna structure of the present invention. The antenna structure of the present invention includes a horn disposed on a substrate for focusing electromagnetic energy with respect to an antenna. The antenna is suspended relative to the horn to receive or transmit the electromagnetic energy focused thereby.

DESCRIPTION OF THE INVENTION

Figure 1:
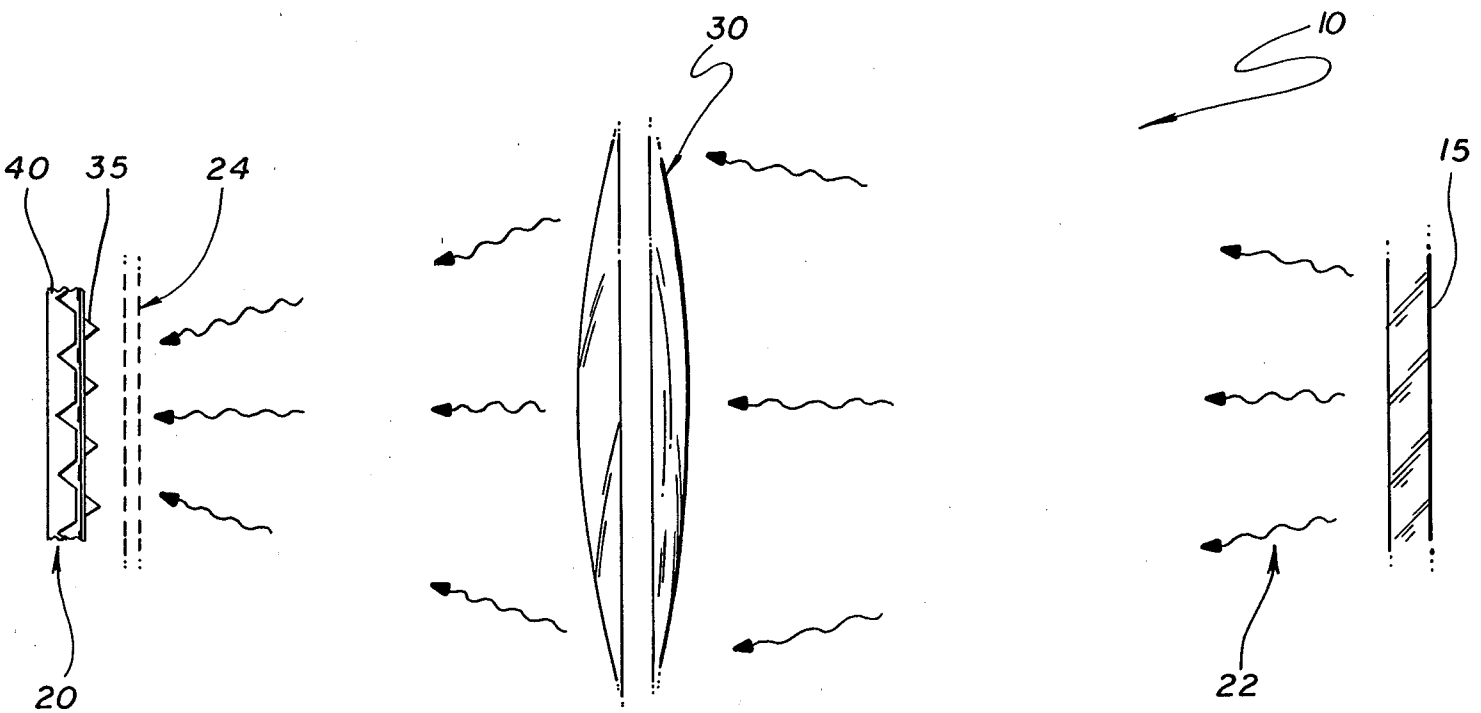
FIG. 1 is a side view of an imaging system which includes a preferred embodiment of the antenna structure of the present invention.

FIG. 1 shows an illustrative operational environment of an imaging system 10 which includes the antenna structure 20 of the present invention. The antenna structure 20 is positioned in the focal plane of a lens 30. The lens 30 is positioned between an object 15 and the antenna structure 20. A portion of the electromagnetic radiation 22 transmitted and/or reflected by the object 15 is incident on the lens 30. Radiation 22 incident on the lens 30 is focused within the focal plane of the lens 30 into an image 24 of the object 15. Thus the antenna structure 20 is placed in the focal plane of the lens 30 and oriented to detect the image 24.

As discussed more fully below, the antenna structure 20 of the present invention includes an array of millimeter or submillimeter wave antennas suspended on a membrane 45 within a plurality of horns formed on a substrate. A three element segment of the antenna structure 20 is shown in cross section in FIG. 2. The antenna structure 20 includes a plurality of horns 92, 94 and 96 provided by front cavities 50, 55 and 60 on a front substrate 35 and rear cavities 65, 70 and 75 on a back substrate 40 respectively. The front substrate 35 and back substrate 40 may be formed from a monolithic block of silicon of known thickness.

Figure 2:
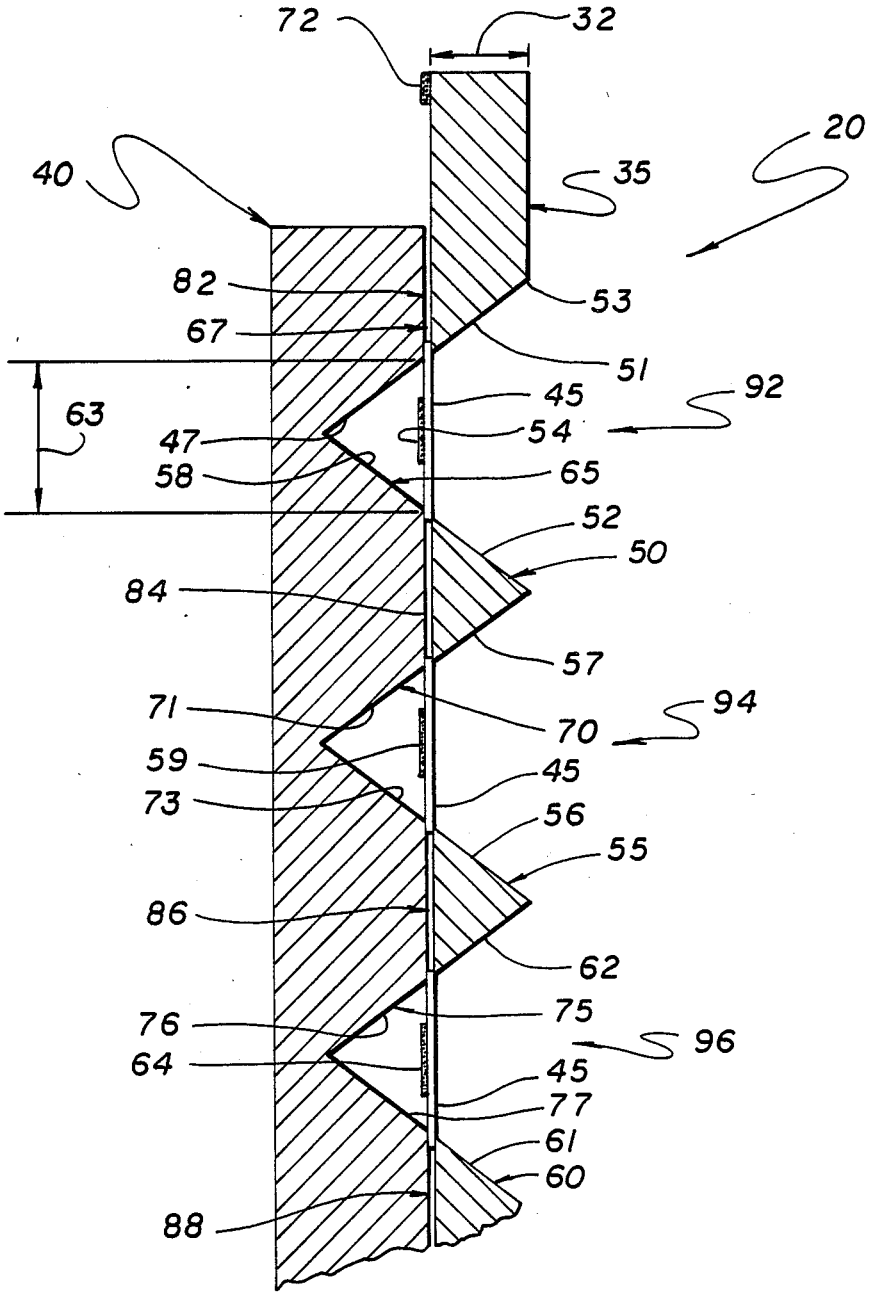
FIG. 2 is a cross sectional view of a prferred embodiment of the antenna structure of the present invention.

The front cavities e.g. 50, 55 and 60 are etched in the front substrate 35 down to the membrane 45. The front cavities 50, 55 and 60 may be etched in the front substrate 35 by a number of etching processes familiar to those skilled in the art, e.g., chemical etching, plasma etching, reactive and ion etching. A particular chemical etching method for forming the front cavities 50, 55 and 60 in the front substrate 35 includes patterning a block of silicon in a conventional manner to define the peripheries of the front cavities 50, 55 and 60. The patterned silicon block is immersed in an ethylenediamine-pyrocatecol solution wherein the front cavities 50, 55 and 60 are formed by anisotropic etching proceeding along the <111> crystal planes of the silicon block. Thus, each of the front cavities is provided by a number of sidewalls. For example, the first front cavity 50 is formed by four sidewalls of which two 51 and 52 are shown in FIG. 2. Sidewalls 51, 52, 56, 57, 61 and 62 lie in <111> crystal planes and make an etching angle of 54.7 degrees with the front surface 53 of the front substrate 35. The antennas 54, 59 and 64 are then either mounted by conventional means or lithographically defined on the membrane 45. Those skilled in the art will appreciate that the antennas may be fabricated on the membrane prior to the formation of the cavities. Portions of the membrane 45 may be removed by conventional means to leave spaces 82, 84, 86 and 88 for signal processing/detection electronics associated with the antennas 54, 59 and 64. The membrane 45 is therefore formed of a plurality of membranes mounted between the front and back substrates at the cavities.

The back structure 40 includes plural pyramid shaped reflecting rear cavities e.g. 65, 70 and 75 each bounded by four surfaces of which two are shown 47 and 58, 71 and 73, and 76 and 77 respectively. The reflecting rear cavities 65, 70 and 75 may also be formed by the aboveidentified etching processes familiar to those skilled in the art. When the chemical etching process described above is used, the etching angle together with the first substrate thickness 32 determine the width 63 at the opening of the reflecting rear cavities 65, 70 and 75. Knowledge of the width 63 allows the back substrate 40 to be patterned and etched such that when the reflecting rear cavities 65, 70 and 75 are positioned adjacent to the front cavities 50, 55 and 60 the sidewalls 51, 52, 56, 47, 61 and 62 are in alignment with the surfaces 57, 58, 71, 73, 76 and 77. Etching of the back substrate 40 continues until the rear cavities 65, 70 and 75 assume a pyramidal shape.

The horn surfaces may be coated with a layer of gold or other suitably reflective material as is known in the art to enhance the performance characteristics of the horn.

The substrates 35 and 40 are mated using conventional adhesion methods to affix the front substrate 35 to the back substrate 40. Thus, as mentioned above, the union of the front cavities 50, 55 and 60 and the reflecting rear cavities 65, 70 and 75, by mating the substrates 35 and 40, form the horns 92, 94 and 96. As is evident upon inspection of FIG. 2, the thickness 32 of the front substrate 35 determines the longitudinal position of the antennas 54, 59 and 64 within the horns 92, 94 and 96. Optimum positioning of the antennas 54, 59 and 64 within the horns 92, 94 and 96 may be empirically determined by those skilled in the art through computer simulation or through measurements utilizing an appropriate microwave model. Thus, the front and back substrates may be dimensioned to locate the membrane 45 at a desired depth within the horn.

The back surface 67 of the front substrate 35 may be utilized for interconnections, detection elements and signal processing circuitry as is known in the art. (See FIG. 4 below.) A bonding pad 72 provides external connection for the structure 20.

The membrane 45 is deposited on the silicon block by conventional techniques prior to the etching of the horns. The membrane 45 is made of silicon nitride, silicon oxynitride or other materials which are electrically transparent to frequencies to be detected. (In the preferred embodiment membrane 45 is of silicon nitride and is approximately 1 micron thick.) Hence the antennas 54, 59 and 64 may radiate as if they were suspended in free space unencumbered by auxiliary supporting structures. Those skilled in the art can fabricate membranes having different frequency response characteristics more suitable for other applications. The millimeter and submillimeter wave antennas e.g., 54, 59 and 64 are mounted on the back surface of the membrane 45 and hence suspended within the horns.

When the antenna structure 20 is disposed for receiving electromagnetic energy, the horns 92, 94 and 96 focus and reflect incident radiation for reception by the antennas 54, 59 and 64. The horns 92, 94 and 96 also improve the collection efficiency of incident radiation relative to conventional antenna structures having antenna element spacing comparable to the spacing between the antennas 54, 59, and 64. It follows that the antenna structure 20 allows more efficient collection of incident radiation without increasing the density of antenna elements. Increased antenna element density may increase potentially undesirable electromagnetic coupling between antenna elements and may limit space for interconnections and associated detection/signal processing circuitry. If the antenna structure 20 is utilized for transmission of electromagnetic energy, radiation emitted by the antennas 54, 59 and 64 is reflected and focused by the horns 92, 94 and 96 to produce desired antenna patterns.

Figure 3:
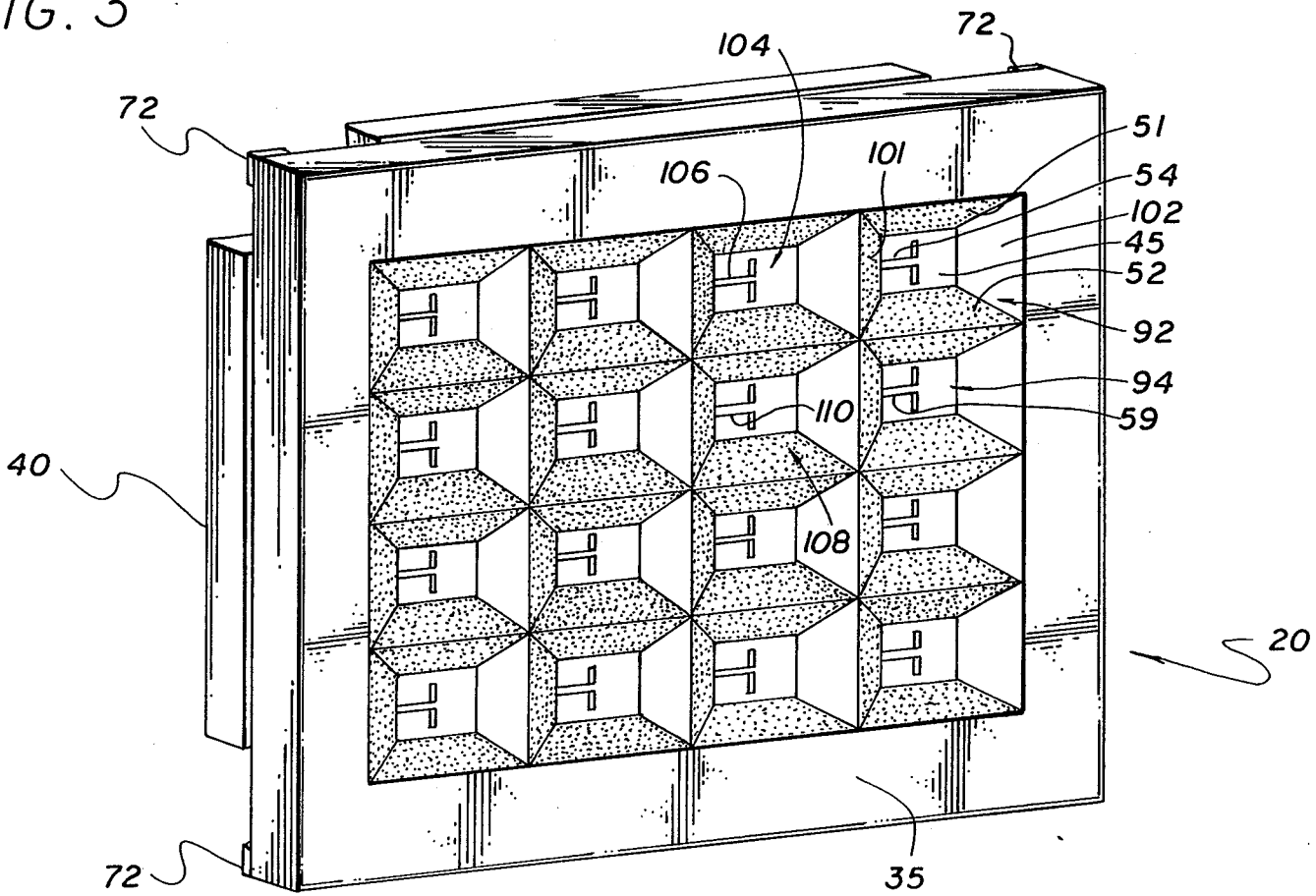
FIG. 3 is a front view of an arrayed embodiment of the antenna structure of the present invention.

FIG. 3 shows a front view of the antenna structure 20 of the present invention. Again, the structure 20 includes the front substrate 35, the back substrate 40, the membrane 45, a plurality of horns including horns 92, 94, 104 and 108, and bonding pads 72. The horn 92 is provided by the sidewalls 51, 52, 101 and 102. The antenna 54 is mounted on the membrane 45 which is sandwiched between the front substrate 35 and the back substrate 40. The antenna 54 is positioned over the pyramidal shaped reflecting cavity 65 (not shown) etched in the back substrate 40.

As discussed above, prior planar substrate antenna arrays suffered in performance from a less than optimum packing density due to the requirement that the elements be spaced to allow for interconnections and to minimize electromagnetic coupling between antenna elements. The present invention substantially addresses this shortcoming in the art by: (1) using a horn structure to collect and focus electromagnetic radiation and (2) fabricating the horn structure monolithically in an integrated circuit substrate, which in turn permits high effective packing densities. These features of the invention allow for improved collection efficiency.

Figure 4:
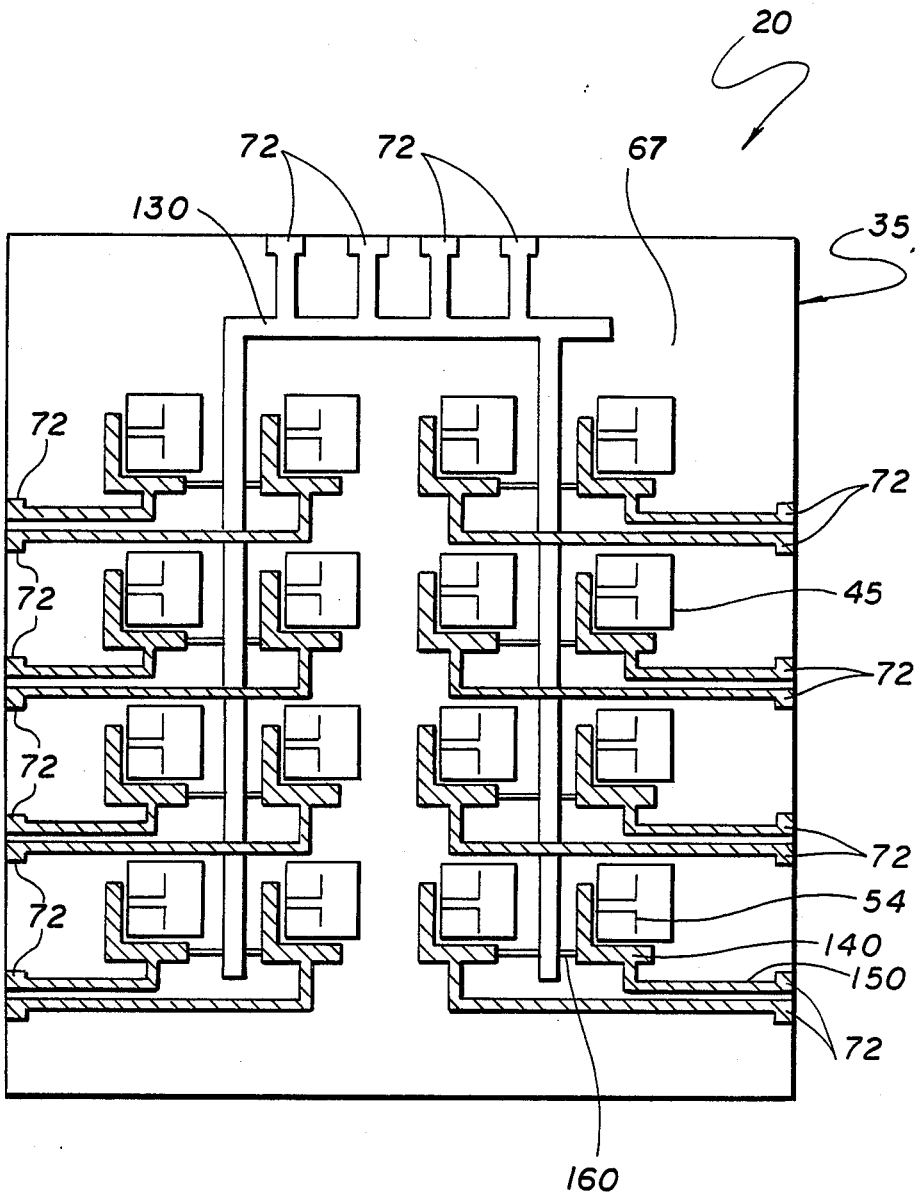
FIG. 4 is a rear view of a front substrate included in an arrayed embodiment of the present invention.

FIG. 4 shows an illustrative rear view of the front substrate 35 for the purpose of showing the availability of space for interconnections, and processing/detection electronics. The rear surface 67 of the front substrate 35 includes a multi-purpose bus 130, the membrane 45, the antenna 54, processing electronics 140, an RF lead 150, and a high impedance line 160. Processing electronics 140 may be responsive to signals from the antenna 54 or as associated detector (not shown). RF signals may be filtered or otherwise operated upon by processing electronics 140 prior to being transmitted via the RF lead 150. The high impedance line 160 provides a path for transmission of DC bias, clock pulses and address commands between the multi-purpose bus 130 and processing electronics 140. Lithographic techniques known to those skilled in the art may be used to define the multipurpose bus 130, processing electronics 140, the RF lead 150 and the high impedance line 160 on areas of the rear surface 67 of the front substrate 35 where the membrane 45 has been removed by conventional techniques. Bonding pads 72 aid in mounting the front substrate 35 and provide external connection for the structure 20.

The present invention has been described with reference to a particular two-dimensional suspended antenna array designed to provide space for associated electronics and to minimize potentially undesirable electromagnetic coupling. It is understood that other means of suspending an antenna relative to a horn may be utilized without departing from the scope of the present invention. It is also understood that certain modifications can be made with regard to selection of substrate and membrane materials without departing from the scope of the invention. For example, gallium arsenide may be used instead of or with silicon as a material for front and/or rear substrate sections. Similarly, other etching and lithographic techniques known to those skilled in the art may be utilized to form alternative embodiments of the antenna structure of the present invention. For example certain etching techniques may yield horn profiles which differ from those described herein. In addition, the invention is not limited to a particular substrate orientation relative to an antenna for focusing electromagnetic energy. With access to the teachings of this invention, it may be obvious to one of ordinary skill in the art to provide this function with another suitable configuration. It is contemplated by the appended claims to cover these and any other such modifications.

Accordingly,

What is claimed is:

1. A method of fabricating an integrated circuit antenna structure for transmitting or receiving millimeter and/or submillimeter wave electromagnetic energy comprising the steps of:

(a) depositing a membrane material on a surface of a first substrate;

(b) etching a plurality of front cavities in said first substrate wherein said etching proceeds until encountering said membrane material;

(c) mounting antenna elements on said membrane material;

(d) etching a plurality of pyramid shaped rear cavities in a second substrate;

(e) mating said first and second substrates such that said membrane material is sandwiched between said substrates and said front cavities are aligned with said rear cavities thereby forming a plurality of horns.

2. A method of fabricating an antenna structure for transmitting or receiving millimeter and/or submillimeter wave electromagnetic energy comprising the steps of:

(a) depositing a membrane material on a first surface of a first substrate;

(b) defining a first pattern on a second surface of said first substrate;

(c1) etching a plurality of front cavities in said first substrate in accordance with said pattern, said etching proceeding until encountering said substrate;

(c2) selectively removing portions of said membrane to provide a plurality of spaces between the remaining portions of membrane material;

(d) mounting antenna elements on said remaining membrane material;

(e) defining a second pattern on a surface of a second substrate;

(f) etching a plurality of rear cavities on said surface of said second substrate in accordance with said second pattern;

(g) mating said first and second substrates such that said membrane material is sandwiched between said substrates and said front cavities are aligned with said rear cavities thereby forming a plurality of horns.

3. An integrated circuit antenna structure for transmitting or receiving millimeter and/or submillimeter wave electromagnetic energy comprising:

a first substrate having a plurality of first cavities extending therethrough, each of said first cavities having slanted sidewalls;

a second substrate bonded to said first substrate and having a plurality of second cavities therein, each of said second cavities having sidewalls slanted such that said second cavities are pyramid shaped and aligned with respective sidewalls of said first cavities to extend said pyramid shape to provide a respective plurality of pyramid shaped horns;

a plurality of electrically transparent membranes mounted between said first and second substrates at said first and second cavities; and a plurality of antennas mounted on said plurality of membranes and suspended thereby within said horns.

4. The integrated circuit antenna structure of claim 3 wherein said antennas are connected to processing circuitry mounted between said first and second substrates.

* * * * *